United States Patent [19]

Patton et al.

[11] 4,074,381

[45] Feb. 21, 1978

[54] WATER SCOOTER

[76] Inventors: Ann T. Patton, 3042 Holdridge, Waukegan, Ill. 60085; Betty Ann Roscetti, 738 W. Wrightwood No. 1, Chicago, Ill. 60614; Lisa Held, 3042 Hildridge, Waukegan, Ill. 60085

[21] Appl. No.: 713,016

[22] Filed: Aug. 9, 1976

[51] Int. Cl.[2] ..... A63B 31/00

[52] U.S. Cl. ..... 9/310 J; 9/11 R; 9/301

[58] Field of Search ..... 9/13, 11 R, 11 A, 2 A, 9/347, 348, 301, 310 J, 310 F, 342; 5/82

[56] References Cited

U.S. PATENT DOCUMENTS

| | | | |
|---|---|---|---|
| 1,107,652 | 8/1914 | Burton | 9/13 |
| 2,674,746 | 4/1954 | Kaff | 5/82 |
| 2,972,758 | 2/1961 | Belin | 9/11 R |
| 3,628,206 | 12/1971 | Mecham | 9/11 A |
| 3,761,982 | 10/1973 | Hawkins | 9/342 |

FOREIGN PATENT DOCUMENTS

| | | | |
|---|---|---|---|
| 359,438 | 10/1931 | United Kingdom | 9/11 |

*Primary Examiner*—Trygve M. Blix
*Assistant Examiner*—Sherman D. Basinger
*Attorney, Agent, or Firm*—George R. Douglas, Jr.; Sherman Levy

[57] ABSTRACT

A new and improved water scooter for serving to facilitate sensory motor integration comprising a pair of spaced apart floatation devices of generally prismatic configuration and being constructed of generally soft, pliable flexible material throughout, being covered with nylon-reinforced waterproof canvas, a connecting nylon reinforced waterproof, hammock-forming canvas disposed around each of the floatation devices, and fastening devices on each of the connecting canvas and the floatation devices for securing the parts together and for allowing adjustments in size. An attachment strip of nylon reinforced waterproof canvas extends throughout the length of the floatation device and the connecting canvas provides for lending security to the apparatus of the water scooter, and the fastening devices are grommets for sizing and for anchoring bottom supporting material.

1 Claim, 7 Drawing Figures

FIG. 1
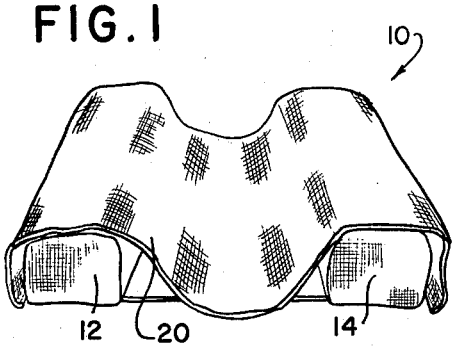
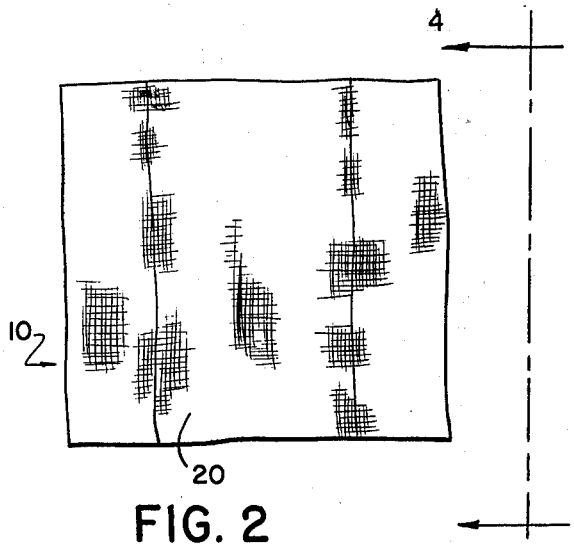
FIG. 2
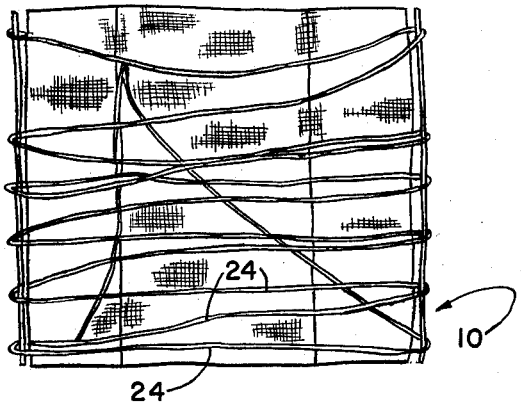
FIG. 3
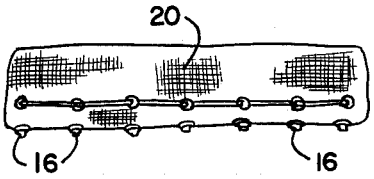
FIG. 4
FIG. 3A
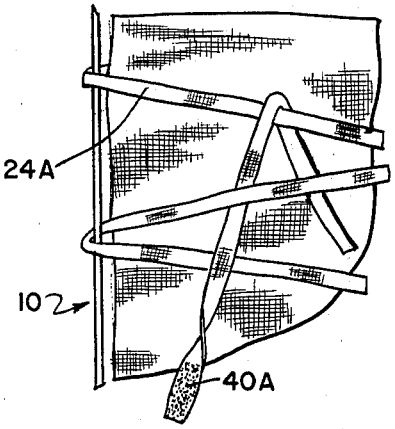
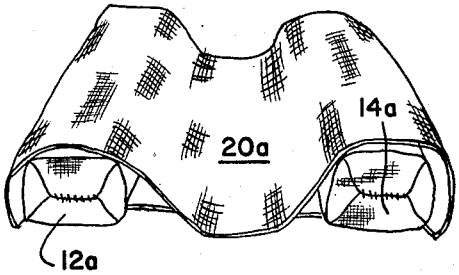
FIG. 5
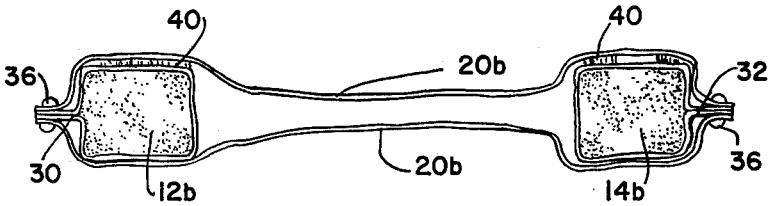
FIG. 6

WATER SCOOTER

BRIEF SUMMARY OF THE INVENTION

The present invention relates to a new improved water scooter to facilitate sensory motor integration by the user, and comprises a spaced-apart floatation device of generally prismatic configuration constructed of soft pliable, flexible material covered with nylon reinforced water-proofed canvas or the like, and more particularly the invention relates to means including fastening devices on the canvas portions thereof for securing the parts together comprising the floatation devices and for providing and lending security to the person using the apparatus thereof.

BACKGROUND OF THE INVENTION

The water scooter is a device to facilitate integration of the tonic labyrinthine reflex. The construction of the water scooter allows it to be soft, flexible, and size adjustable. It is light, compact, and easy to store and to transport.

According to A. Jean Ayres, on page 121 of *Sensory Integration and Learning Disorders,* Western Psychological Services, Los Angeles, Calif. 90025 "If the child's head is in a position that approximates that of the prone or quadruped position, the sensory flow from the gravity receptors more closely approaches that which would be expected to integrate optimally with other sensations at the brain stem level." Further, he says, "it is assumed that the locomotor patterns in the brain stem in man are closely related to the visual organization that takes place there and that those locomotor patterns are in some way connected with the appropriate sensory input from the locomotor system".

Unlike the styrofoam kick boards, which are buoyant but easily tipped, the buoyance and large hammock base of the water scooter of the invention disclosure fits snuggly around the child's torso to allow maximum security. Therefore, it reduces the child's anxiety and fear of the overwhelming power of gravitational force and of the water. Because the structure of the water scooter of the invention disclosure reduces the child's anxiety and because of the added proprioceptive input to the central nervous system, he is able to direct his energies to a more functional locomotor output. A child is able to direct his energies to a more functional locomotor output. A child prone in the water scooter is forced into a position of neck extension with back arched in order to keep his face out of the water. Muscle contractions of the neck, against gravitational resistance, enhances proprioceptive input into the central nervous system. The hammock of the water scooter is designed to allow freedom of movement of all limbs, which are readily used for locomotion. Kinesthesia, as a source of sensory feedback arising from movement, is enhanced by the resistance of the water to limb movement.

Further A. Jean Ayres has written on page 121 of *Sensory Integration and Learning Disorders* the following: "Total brain stem input is related to the visual-locomotor process." Therefore, once the child has experienced and experimented with the water scooter, advanced activities involving a visual component are desirable. While on the water scooter, the child should be asked to direct his movements to a specific destination. This can be done individually or in a group in the form of races and relays. Or, the child can be required to throw balls at a target. Group games such as water polo or soccer are possible.

In addition to the stated primary purpose, three secondary benefits are achieved. With the support of the water scooter, the child has the opportunity to explore an expanded horizon with physical, psychological, and social experiences in the water.

Individuals showing positive reaction to the experience with the water scooter include the high level trainable child, the educable child, the learning disabled child and the normal child. Adults, who have experienced difficulty and fear associated wwith water activities, found the scooter to be supportive and to allow comfortable movement experiences.

The primary developmental prerequisite appears to be that of comfortable visual input while in a prone position. Those individuals who were very dependent on the visual sensory mode did not react favorably to the prone position and returned as quickly as possible to the supine or vertical position. They appeared to need the security of a more familiar visual environment in space.

The water scooter is not meant to serve as a life saving device but as a device to facilitate sensory motor integration.

FIELD OF THE INVENTION

It is an object and feature of the present invention to provide a new and improved water scooter serving to facilitate sensory motor integration comprising a pair of spaced-apart floatation devices or elements, a sheet disposed over the floatation elements, fastening devices on each of the connecting canvas and floatation devices for securing their parts together and for allowing for adjustments in size, together with providing and including Velcro fastener means to lend to the versatility in adjustment, said floatation elements being provided with an attachment strip of nylon reinforced waterproof canvas extending throughout the length of the floatation device and connecting the sheet for lending security of the apparatus water scooter and design for serving to facilitate sensory motor integration of the user.

A further and additional object of the present invention is to provide a floatation device or element of soft, pliable, buoyant material covered with nylon reinforced waterproof canvas.

It is a further and additional object of the invention to provide lacing and strap elements disposed over the sheet for incrementing the use of the apparatus and within the purposes and objects of the present invention.

The above and other objects and advantages of the invention will become apparent upon full consideration of the following detailed description and accompanying drawings in which are as follows:

FIG. 1 is a generally perspective view of the improved water scooter and design and according to a preferred embodiment of the present invention;

FIG. 2 is a generally planned view thereof;

FIG. 3 is a generally planned view of a modification of the present invention showing lace structure disposed throughout the water scooter apparatus;

FIG. 3A is a broken away view of a modification of FIG. 3;

FIG. 4 is a side elevation view taken alone lines 4—4 of FIG. 2;

FIG. 5 is a modification of the arrangement shown in FIGS. 1 and 2, and in which there is provided canvas coverings for the floatation elements according to another best mode of the present invention;

FIG. 6 is a cross section of view of another embodiment of the best mode of the present invention showing attachment strip means extending from the floatation elements and to which the cover sheet is secured by grommets and in which there is Velcro elements interfacing between the floatation device surface and the mating surface of the top cover sheet, within a purview of the present invention.

DETAILED DESCRIPTION OF THE PREFERRED EMBODIMENT OF THE PRESENT INVENTION

Referring now to the drawings there is shown a swimming aid and water scooter apparatus 10 serving to facilitate sensory motor integration comprising elongated floatation elements 12, 14 spatially disposed apart in generally parallel relations. This distance that these floatation elements are apart is the distance measured by the transverse dimension of the body of the user, and is generally between about 12 inches to 24 inches, measured from the closest surfaces of the floatation elements to each other. The floatation elements are constructed of material that is flexible and resilient in construction and may comprise waterproof material, is soft, pliable, buoyant foam material that is covered with nylon, as an example reinforced with waterproof canvas. Each of the floatation elements 12, 14 is constructed along the side thereof for receiving grommets 16 such as shown in FIG. 4 for securing a sheet 20 of waterproof canvas or plastic material provided to overwrap the pair of floatation elements 12, 14 and comprise a completed loop structure about said pair of floatation elements. The grommets are placed securely through the sheet 20 and into the adjacent portion of floatation elements 12, 14 to fix the loop structure about the floatation elements.

In FIG. 3 there is shown a preferred arrangement in which lacing 24, is combined for providing hand-grasping features for use of the body or person for securing a hand-hold on to the swimming aid and water scooter 10.

In FIG. 5 is shown a modification of the best mode of the invention by which there is provided a nylon reinforced waterproof canvas cover for the flexible elements **12*a*, 14*a* so that the flexible element itself may be of a soft, pliable buoyant material. The coverings or the actual floatation elements themselves may be be provided with an attachment strip 30, 32 suggested and as shown in FIG. 6 by means of which the cover 20b** may be securely attached and fixedly engaged therewith by means of grommets being placed into the strip to provide for size adjustment and means for placing and anchoring the bottom support material thereto. The covers run the length of the floatation devices as is generally shown in the drawing.

Also shown in FIG. 6 is attachment means 40 which is a Velcro fastening or securing element to provide adjustment in the length of the top sheet **20*b* as shown and described. The top cover sheet b may be made to provide a more or less hammock effect of the top sheet over that of the bottom sheet 20*b* and it is also found by means of the present invention that a Velcro fastening means 40, provides a slight effect of cushioning for the body against the surface of the flexible elements 12*b*, 14*b*. FIG. 3A is a broken away view showing how the elements 24 may be shown as straps 24A and that they may be secured to each other and to a Velcro fastener means 40A**.

It is seen by the present invention that the length of the apparatus along the access of the user may be a distance or measurement of about between one and three times of the distance that the floatation elements 12, 14 are measured apart. The grommets 16, as well as 36, may be preferably disposed in rows along the length of the dimension of the attachment strip.

In one embodiment it is seen that the sheet of the apparatus may be provided with a slightly longer dimension of sheet on the top than on the bottom and that a Velcro fastening or securing means may be used to provide adjustments of the loop or hammock effect of the top sheet. The Velcro means provides adjustment in securing and also a cushioning means for the body using the apparatus.

By means of the present invention there is seen to be provided a new and improved water scooter and design forming a hammock swim means for a body as apparatus used as an improvement water scooter serving to facilitate sensory motor integration for a user within the purview and features of the present invention.

Additional embodiments of the invention in this specification will occur to others and therefore it is intended that the scope of the invention be limited only by the appended claims and not by the embodiment(s) described hereinabove. Accordingly, reference should be made to the following claims in determining the full scope of the invention.

What is claimed is:

1. A swimming aid and water scooter apparatus comprising a pair of elongated flexibly and resiliently disposed flotation elements spatially disposed apart in general parallel relation at a distance measured by the transverse dimension of the body to use the apparatus, a sheet of waterproof canvas or plastic provided to overwrap the pair of flotation elements to comprise a completed loop structure about said pair of flotation elements, and a selective arrangement of a plurality of grommets placed securely through the sheet into the adjacent portion of the flotation element to fix the loop structure about the flotation elements, the loop structure being provided with lacing to add resistance to the sheet so that the body is less likely to slide off the apparatus, the length of the apparatus being between one and three times of the distance the flotation elements are apart, the flotation elements being of soft, pliable, buoyant foam material covered with nylon reinforced waterproof canvas, and each of the flotation elements being constructed along a side thereof to provide an attachment strip to which the grommets are secured in rows along the length dimension of said attachment strip, said sheet of the apparatus is provideed with a slightly longer dimension of sheet on a top than on a bottom side to provide a body-receiving-surface when the apparatus is to be used, the ends of the flotation elements are covered with said nylon reinforced waterproof canvas, a Velcro fastening means is disposed on mating surfaces between the flotation elements and the sheet to provide a securing means and a cushioning means for the body using the apparatus, and a top loop of said sheet forms a hammock forming means for the body as the apparatus is used as an improved water scooter and design in serving to facilitate sensory motor integration for a user.

* * * * *